US005987660A

United States Patent [19]

Wang

[11] Patent Number: 5,987,660

[45] Date of Patent: Nov. 23, 1999

[54] WATER JET CLEANING DEVICE FOR TOILET

[75] Inventor: Chi Hung Wang, Taichung, Taiwan

[73] Assignee: Wei Ban Lin, Taichung, Taiwan

[21] Appl. No.: 09/175,095

[22] Filed: Oct. 19, 1998

[51] Int. Cl.[6] ..... E03D 9/08

[52] U.S. Cl. ..... 4/420.4; 4/448

[58] Field of Search ..... 4/420.4, 447, 448

[56] References Cited

U.S. PATENT DOCUMENTS 3,570,015 3/1971 Rosengaus ..... 4/420.4

5,384,919 1/1995 Smith ..... 4/448

*Primary Examiner*—Robert M. Fetsuga

[57] ABSTRACT

A water jet cleaning device for a includes a base and a cover secured to a toilet. A tube is secured in the base has a lower end coupled to a water tank. A pipe is secured on the tube and has an upper end extended outward the cover and has an outlet coupled to a sprayer head and has a valve seat. A rod is received in the pipe and has a plug for engaging with the valve seat of the pipe and a spring may bias the plug to engage with the valve seat. A water jet may flow out of the sprayer head via the pipe when the plug is forced away from the valve seat against the spring.

6 Claims, 6 Drawing Sheets

WATER JET CLEANING DEVICE FOR TOILET

BACKGROUND OF THE INVENTION

1. Field of the Invention

The present invention relates to a cleaning device, and more particularly to a water jet cleaning device for a toilet.

2. Description of the Prior Art

Typically, people may assemble, by themselves, a spray nozzle or a spray gun to a water tank for cleaning purposes after visiting john and doing No. 1 job. However, it will be difficult for the user to use or operate such a spray device.

The present invention has arisen to mitigate and/or obviate the afore-described disadvantages of the conventional toilets.

SUMMARY OF THE INVENTION

The primary objective of the present invention is to provide a water jet cleaning device for attaching to a toilet and for allowing the user to easily operate the cleaning device.

In accordance with one aspect of the invention, there is provided a water jet cleaning device for attaching to a toilet, the cleaning device comprising a housing including a base and a cover secured on the base, the cover including an upper portion, means for attaching the housing to the toilet, a tube received in the base and including a lower end extended outward of the base for coupling to the toilet and including an upper end, a pipe including a lower end secured to the upper end of the tube and including an upper end extended outward through the upper portion of the cover and secured to the upper portion of the cover, the pipe including a bore formed therein and including an outlet and including a valve seat provided therein, a conduit including a first end secured to the outlet of the pipe and including a second end having a spray head secured thereto, a rod slidably received in the bore of the pipe and including a lower portion having a plug provided thereon for engaging with the valve seat of the pipe and for blocking the bore of the pipe, the rod including an upper end extended upward and outward of the cover, and means for biasing the plug to engage with the valve seat. A water jet is allowed to flow out through the sprayer head via the outlet of the pipe and the conduit when the plug is forced away from the valve seat against the biasing means.

The lower portion of the rod includes a block secured thereon and includes a gasket engaged on the block for forming the plug.

A device is further provided for making a water tight seal between the rod and the pipe and includes at least one sealing ring engaged between the rod and the pipe, and means for forcing the sealing to engage with the rod and the pipe.

The sprayer head includes an outer portion having an annular recess formed therein and includes a plurality of orifices located at a peripheral portion of the annular recess for directing a water jet toward the user.

The base includes an extension extended outward, the housing attaching means includes a bar for attaching to the toilet and having a channel for receiving and for positioning the conduit, and means for securing he extension of the base to the bar.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
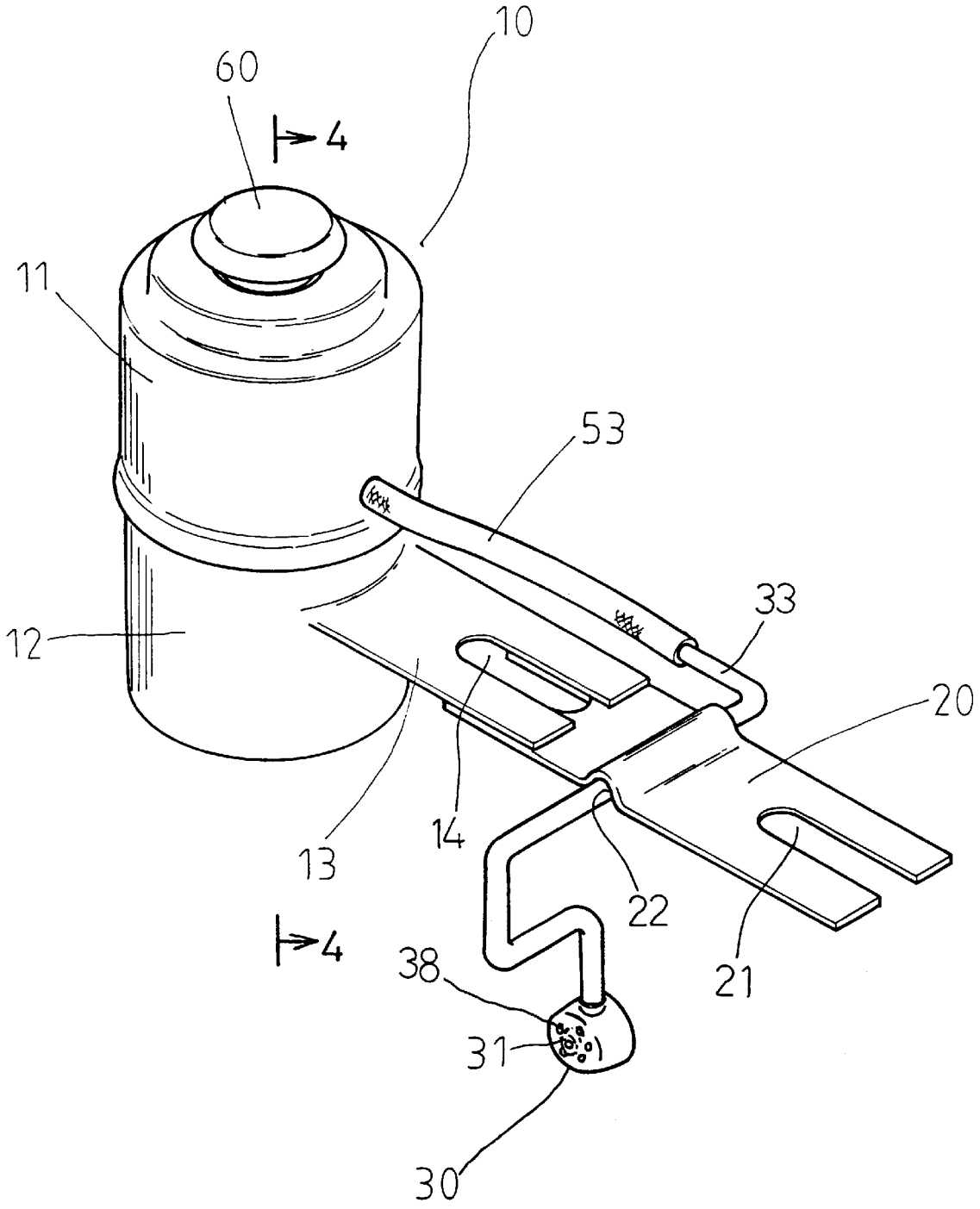
FIG. 1 is a perspective view of a water jet cleaning device in accordance with the present invention.
Figure 2:
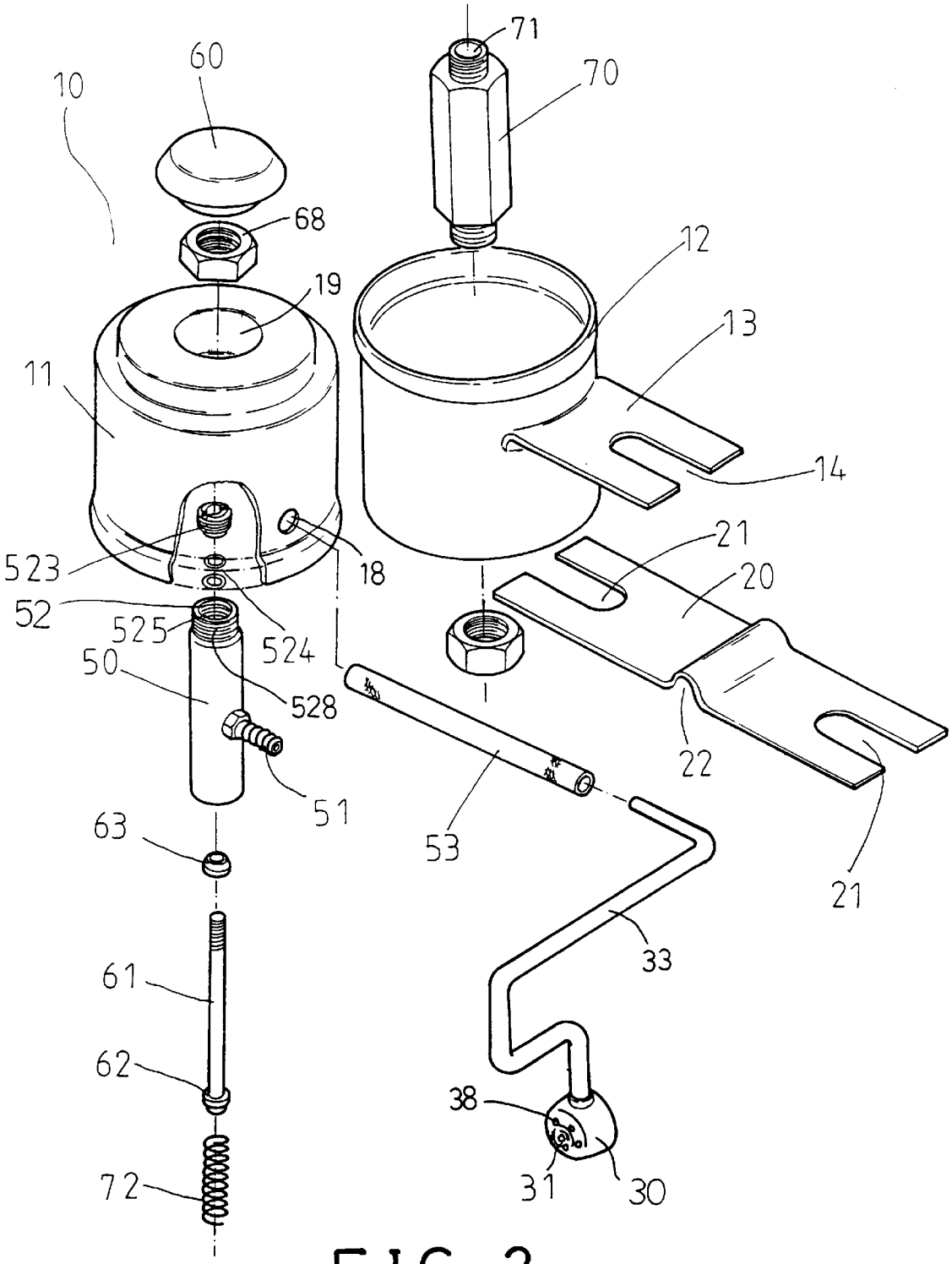
FIG. 2 is an exploded view of the cleaning device.
Figure 3:
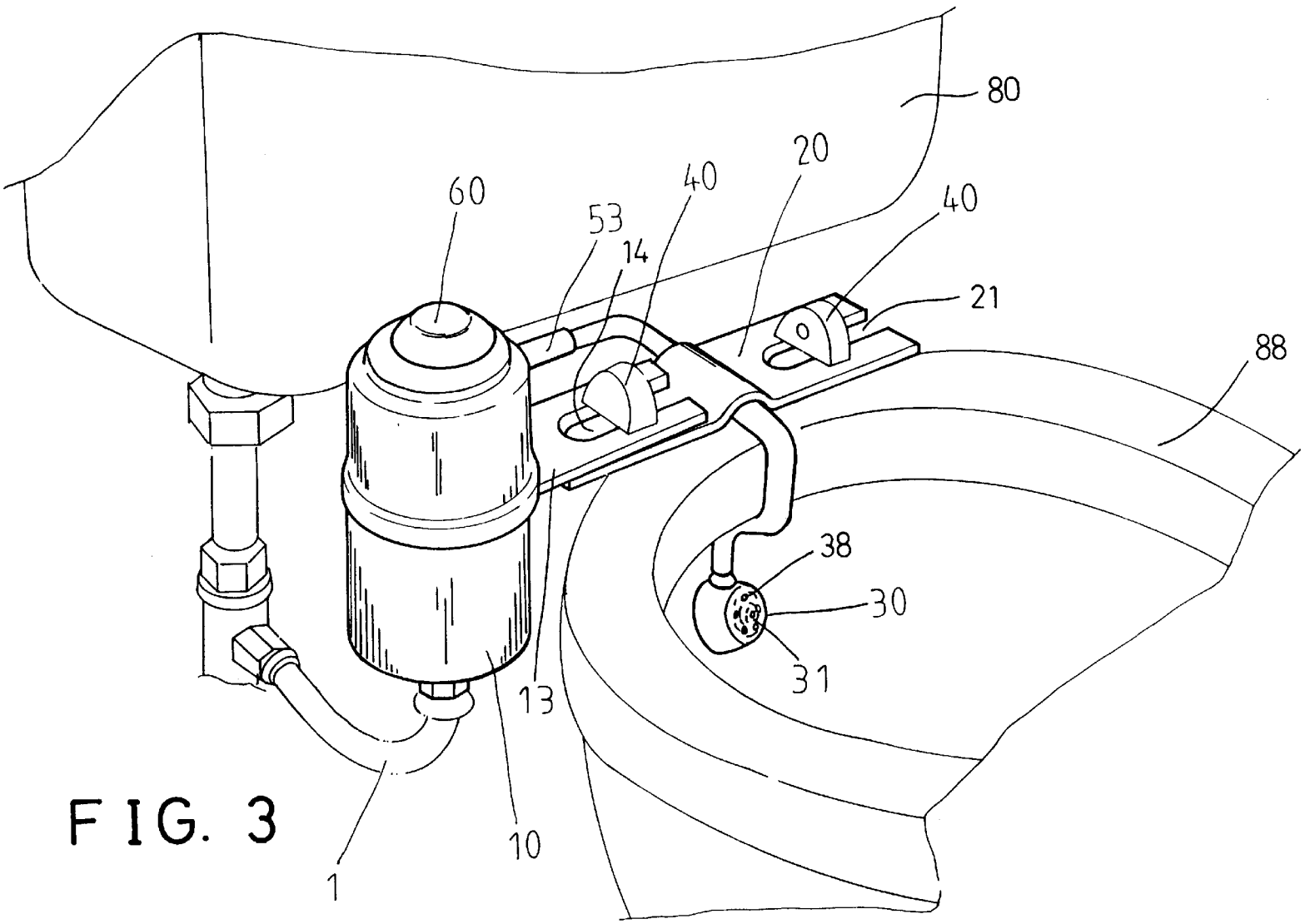
FIG. 3 is a perspective view illustrating the attachment of the cleaning device to the toilet.
Figure 4:
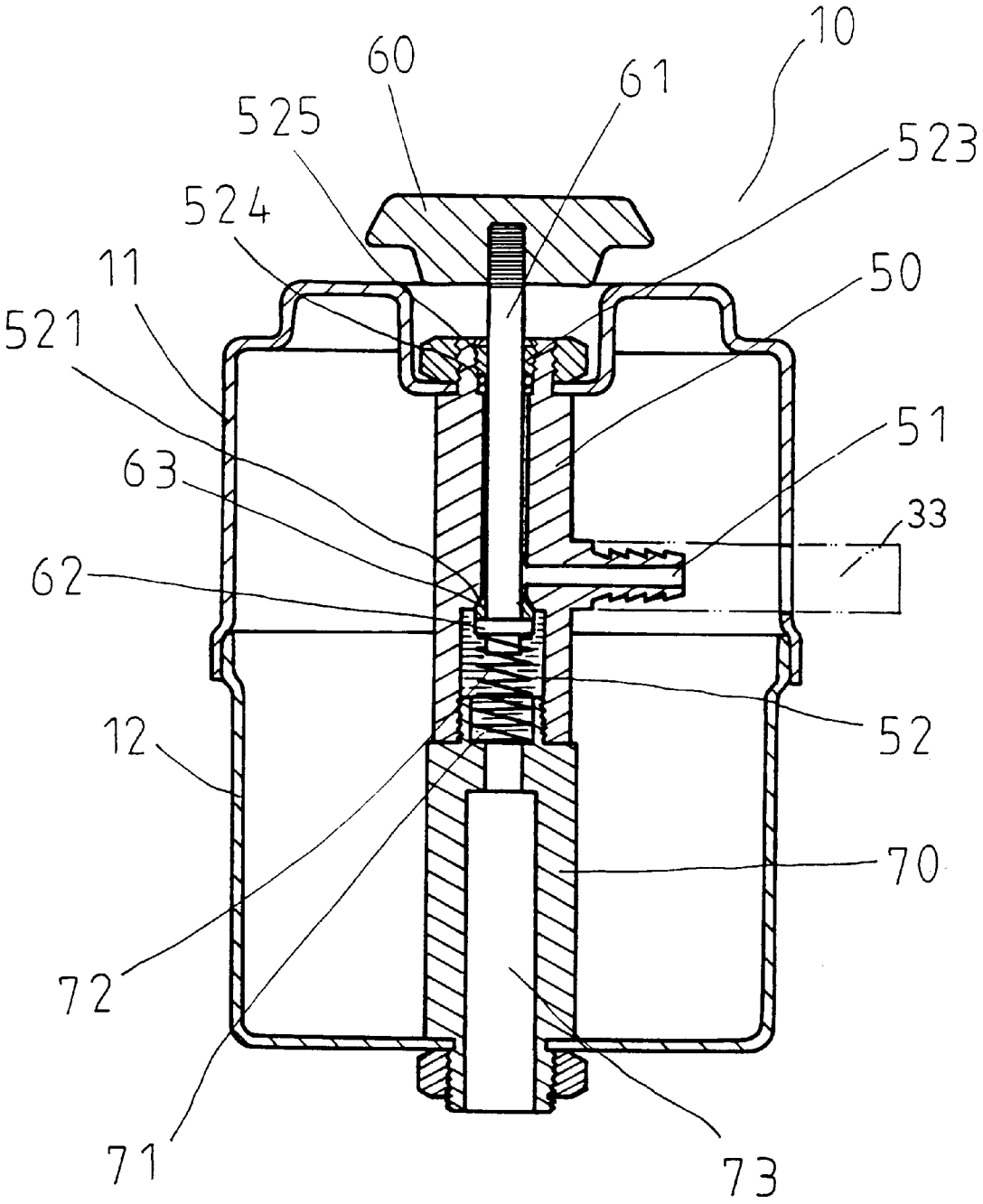
FIG. 4 is a cross sectional view taken along lines 4—4 of FIG. 1.

Referring to the drawings, and initially to FIGS. 1–4, a water jet cleaning device in accordance with the present invention is provided for attaching to a toilet and comprises a housing 10 having a cover 11 secured on top of a base 12. The base 12 includes an extension 13 laterally extended outward therefrom and having a notch 14 formed therein. A bar 20 includes two ends each having a notch 21 formed therein for receiving the fasteners 40, such as hooks and wing nuts, and for attaching to the toilet, particularly for attaching to the toilet bowl 88 of the toilet. The hooks and the wing nuts 40 may also engaged in the notch 14 of the extension 13 for attaching the housing 10 to the toilet (FIG. 3). The bar 20 includes a bulge formed in the middle portion for forming a channel 22 therein. A tube 70 is disposed in the lower portion of the base 12 and includes a lower end extended downward through the bottom of the base 12 (FIGS. 4, 5) for coupling to a water tank 80 of the toilet via a hose 1 (FIG. 3). The tube 70 includes a bore 73 and includes a cavity 71 formed in the upper portion and communicating with the bore 73 for receiving a lower end of a spring 72 (FIGS. 4, 5).

Figure 5:
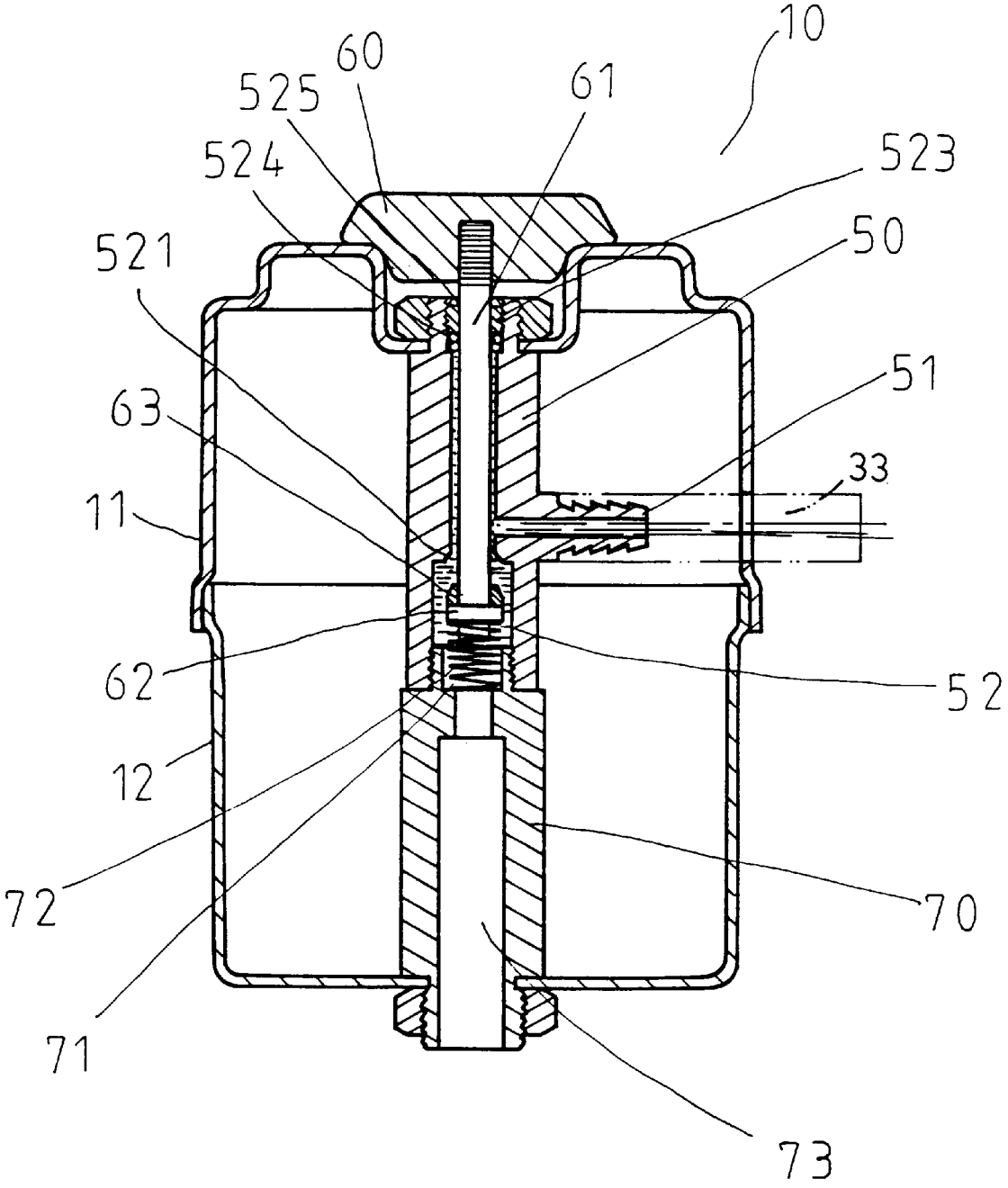
FIG. 5 is a cross sectional view similar to FIG. 4, illustrating the operation of the cleaning device.

The cover 11 includes a puncture 18 formed in the lower portion and includes a depression 19 formed in the upper portion for receiving a nut 68 and for slidably receiving a knob 60 (FIGS. 4, 5). A pipe 50 has a lower end threaded to the upper end of the tube 70 and includes a bore 52 formed therein and includes a valve seat 521 formed in the inner middle portion thereof. The pipe 50 includes an outlet 51 and includes an inner thread 525 and an outer thread 528 formed in the upper portion. The nut 68 is engaged with the outer thread 528 for securing the pipe 50 to the cover 11. A conduit 33 has one end secured to the outlet 51 and has a middle portion engaged through the channel 22 of the bar 20 such that the conduit 33 may he positioned in place. A protective sleeve 53 is preferably engaged on the conduit 33 and engaged with the cover 11 for protecting the conduit 33. A sprayer head 30 is secured to the other end of the conduit 33 and disposed in the inner and rear portion of the toilet bowl 88 for spraying a water jet to clean the user. The sprayer head 30 preferably includes an annular recess 31 formed in the outer or upper portion and the orifices 38 of the sprayer head 30 are located in the peripheral portion of the annular recess 31 and directed toward the middle portion of the upper portion of the toilet bowl 88 for directing the water jet to the anus of the user.

A rod 61 is slidably received in the pipe 50 and has an upper end threaded to the knob 60 for allowing the knob 60 to actuate the rod 61, and includes a block 62 formed in the bottom for supporting a gasket 63 and for allowing the block 62 and the gasket 63 to form a plug to engage with the valve seat 521 (FIGS. 4, 5). The spring 72 has an upper end engaged with the block 62 for biasing the plug 62, 63 to engage with the valve seat 521 and to block the bore 52 of the pipe 50. One or more sealing rings 524 are engaged on the upper portion of the rod 61 and a locking nut 523 is threadedly engaged with the inner thread 525 of the pipe 50 for making a water tight seal between the rod 61 and the pipe 50.

Figure 6:
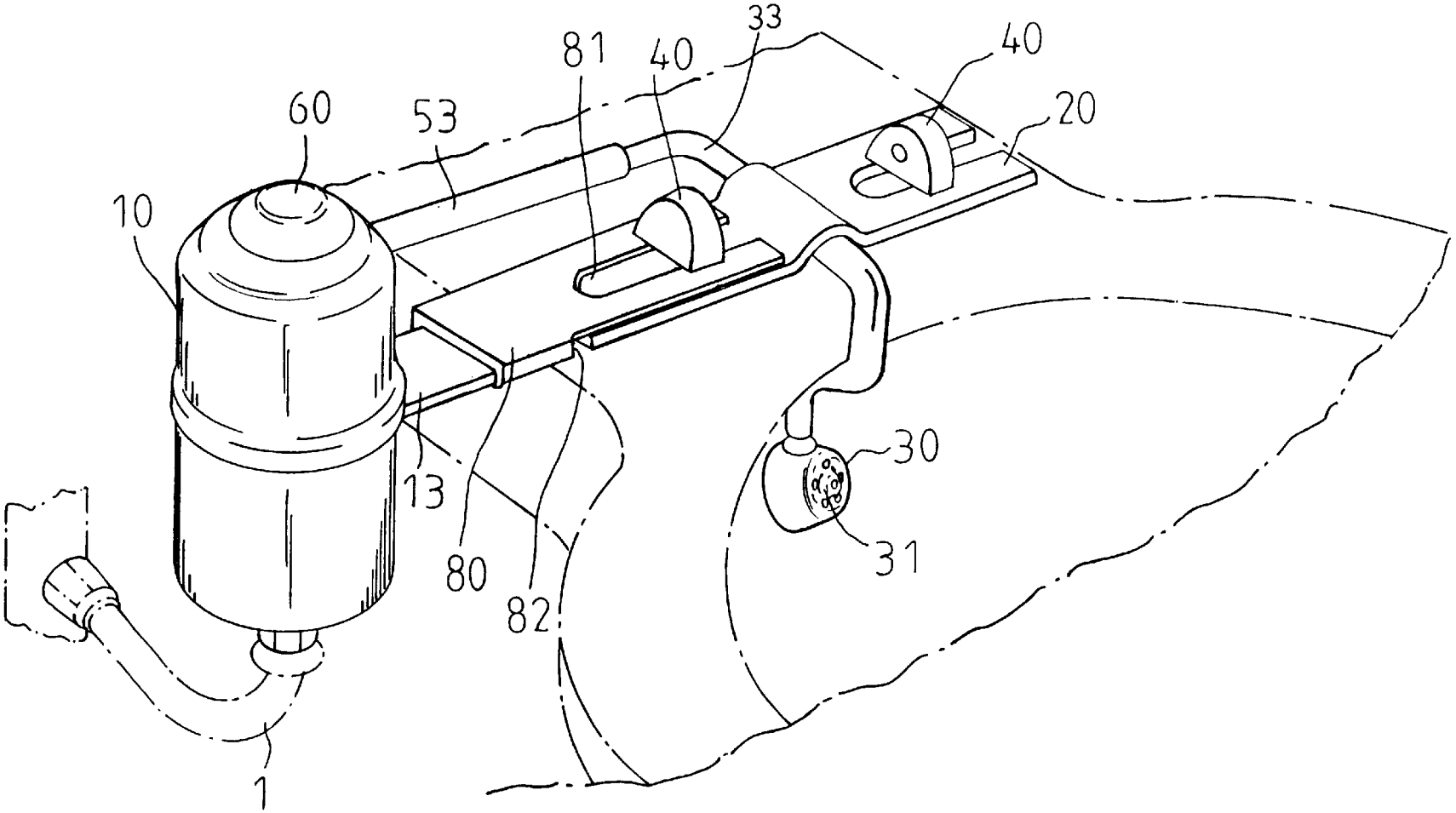
FIG. 6 is a perspective view similar to FIG. 3, illustrating the other application of the water jet cleaning device.

Referring next to FIG. 6, a beam 80 may further be provided and includes one end having a locking channel 82 for receiving the extension 13 of the base 12 and having a notch 81 formed in the other end for engaging with the fasteners 40 and for allowing the housing 10 to be attached to a toilet of a greater size.

In operation, as shown in FIG. 4, the spring 72 may bias the plug 62, 63 to engage with the valve seat 521 for blocking the bore 52 of the pipe 50. As shown in FIG. 5, when it is required to clean the user, it is only required to depress the knob 60 against the spring 72 for disengaging the plug 62, 63 from the valve seat 521 and for allowing the water to flow out of the sprayer head 30 via the outlet 51 and the conduit 33, and for forming a water jet to clean the user. When the knob 60 is released, the spring 72 may bias the plug 62, 63 to engage with the valve seat 521 and to block the bore 52 of the pipe 50 again. The water jet cleaning device may thus be easily operated.

Accordingly, the water jet cleaning device in accordance with the present invention includes a greatly simplified configuration and may be easily attached to the toilet for allowing the user to easily operate the cleaning device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A water jet cleaning device for attaching to a toilet, said cleaning device comprising:

a housing including a base and a cover secured on said base, said cover including an upper portion, means for attaching said housing to the toilet;

a tube received in said base and including a lower end extended outward of said base for coupling to the toilet and including an upper end, a pipe including a lower end secured to said upper end of said tube and including an upper end extended outward through said upper portion of said cover and secured to said upper portion of said cover, said pipe including a bore formed therein and including an outlet and including a valve seat provided therein, a conduit including a first end secured to said outlet of said pipe and including a second end having a spray head secured thereto, a rod slidably received in said bore of said pipe and including a lower portion having a plug provided thereon for engaging with said valve seat of said pipe and for blocking said bore of said pipe, said rod including an upper end extended upward and outward of said cover, and means for biasing said plug to engage with said valve seat, a water being allowed to flow out through said sprayer head via said outlet of said pipe and said conduit when said plug is forced away from said valve seat against said biasing means.

2. The cleaning device according to claim 1, wherein said lower portion of said rod includes a block secured thereon and includes a gasket engaged on said block for forming said plug.

3. The cleaning device according to claim 1 further comprising means for making a water tight seal between said rod and said pipe.

4. The cleaning device according to claim 3, wherein said water tight seal making means includes at least one sealing ring engaged between said rod and said pipe, and means for forcing said at least one sealing to engage with said rod and said pipe.

5. The cleaning device according to claim 1, wherein said sprayer head includes an outer portion having an annular recess formed therein and includes a plurality of orifices located at a peripheral portion of said annular recess for directing a water jet toward the user.

6. The cleaning device according to claim 1, wherein said base includes an extension extended outward, said housing attaching means includes a bar for attaching to the toilet and having a channel for receiving and for positioning said conduit, and means for securing said extension of said base to said bar.

* * * * *